US006224261B1

(12) United States Patent
Stone

(10) Patent No.: US 6,224,261 B1
(45) Date of Patent: May 1, 2001

(54) COMPOSITE CONTAINER FOR LIQUIDS

(75) Inventor: Michael George Stone, Howden (GB)

(73) Assignee: Composite Container Corp., L.L.C., Dallas, TX (US)

( * ) Notice: Subject to any disclaimer, the term of this patent is extended or adjusted under 35 U.S.C. 154(b) by 0 days.

(21) Appl. No.: 09/598,888

(22) Filed: Jun. 21, 2000

Related U.S. Application Data

(63) Continuation-in-part of application No. 09/390,403, filed on Sep. 3, 1999.

(51) Int. Cl.[7] ..... B65D 33/02

(52) U.S. Cl. ..... 383/119; 383/104; 383/105; 220/9.2

(58) Field of Search ..... 383/119, 2, 120, 383/104, 105, 33; 220/9.2

(56) References Cited

U.S. PATENT DOCUMENTS

| | | | | |
|---|---|---|---|---|
| 4,096,987 | * | 6/1978 | Rodish | 383/2 X |
| 4,903,859 | * | 2/1990 | Derby et al. | 383/119 X |
| 5,061,086 | * | 10/1991 | Vallerga | 383/33 X |
| 5,323,922 | * | 6/1994 | Lapoint, Jr. et al. | 383/119 X |
| 5,556,205 | * | 9/1996 | Gallie et al. | 383/105 X |
| 5,897,211 | | 4/1999 | Hafer et al. | 383/119 |
| 5,988,878 | * | 11/1999 | Simonett et al. | 383/2 |
| 6,000,549 | | 12/1999 | Perkins | 206/596 |
| 6,000,604 | * | 12/1999 | Lapoint, III | 383/119 X |
| 6,004,035 | | 12/1999 | Hafer et al. | 383/119 |
| 6,015,057 | * | 1/2000 | Stone et al. | 220/9.2 |

FOREIGN PATENT DOCUMENTS

| | | |
|---|---|---|
| PCT/IE96/00078 | 12/1996 | (WO) . |
| PCT/IE99/00115 | 11/1999 | (WO) . |

* cited by examiner

*Primary Examiner*—Jes F. Pascua
(74) *Attorney, Agent, or Firm*—Michael A. O'Neil

(57) ABSTRACT

The bulk bag comprising a bottom wall, double layer end walls extending upwardly from the bottom wall, double layer side wall portions extending upwardly from the bottom wall and perpendicularly to the end walls, double layer pivotally supported side walls hingedly secured to the side wall portions, stiffening panels received between the double layers of the end walls, the side wall portions, and the pivotally supported side walls, and fasteners for securing the pivotally supported side walls in alignment with the side wall portions.

10 Claims, 11 Drawing Sheets

COMPOSITE CONTAINER FOR LIQUIDS

CROSS-REFERENCE TO RELATED APPLICATIONS

This is a continuation-in-part application under C.F.R. 1.53 of application Ser. No. 09/390,403, filed Sep. 3, 1999, currently pending.

TECHNICAL FIELD

This invention relates generally to flexible intermediate bulk containers also known as bulk bags, and more particularly to a composite container for receiving, storing, transporting, and discharging liquids which is adapted for stacking.

BACKGROUND AND SUMMARY OF THE INVENTION

Historically, flexible intermediate bulk containers (bulk bags) have been used for receiving, storing, transporting and discharging flowable materials of all types. Bulk bags are typically constructed in square, vertically rectangular, or circular shapes with lift straps attached to each of the uppermost corners of the square, rectangle or circle.

By way of example, flexible intermediate bulk containers are used for handling flowable materials in granular or powder form such as chemicals, minerals, fertilizers, foodstuffs, grains and agricultural products, etc. The advantages of such receptacles include relatively low weight, reduced cost, versatility and, in the case of reusable receptacles, low return freight costs.

U.S. Pat. No. 4,903,859 discloses a bulk bag adapted for use with liquids. The bulk bag of the '859 patent comprises four double layer side walls. Stiffeners formed from cardboard are inserted between the layers of the side walls thereby imparting sufficient rigidity to the container to permit its use with liquids. Although the bag of the '859 patent has been generally well received, its utilization is somewhat limited by the fact that it cannot be stacked to facilitate the transportation and storage of the bags and the contents thereof.

The present invention comprises an improved bulk bag design which overcomes the foregoing and other problems long since associated with the prior art. In accordance with the broader aspects of the invention, a bulk bag comprises four double layered side walls. The side walls receive stiffener panels which are formed from wood. Sleeves provided at each corner of the bulk bag receive stiffener rods also formed from wood. The bulk bag is provided with a double layered top which also receives a stiffener panel formed from wood.

When the bulk bag of the present invention is used to receive, store, transport and discharge liquids, it is typically provided with a liner comprising film formed from a plastic material such as polyethylene. In such instances, the bulk bag may be provided with baffles extending diagonally across each interior corner of the bulk bag to prevent the liner from pinching into the corners. When used, the baffles are preferably provided with stiffener panels formed from wood.

In accordance with another aspect of the invention, double layer dividers extend across the interior of the container from the midpoints of the side walls, thereby dividing the interior of the container into four quadrants. When employed, the divider panels are preferably provided with stiffener panels formed from wood.

The use of the present invention is highly advantageous in receiving, storing, transporting, and discharging liquids. For example, the present invention is readily adapted to receiving, storing, transporting and discharging orange juice, tomato paste, and other foodstuffs. Containers constructed in accordance with the invention are adapted for stacking. For example, certain embodiments of the invention can be stacked one on top of the other to a total height of six containers. The stackability of the container of the present invention is highly advantageous in facilitating transportation and storage of the containers and the materials contained therein.

BRIEF DESCRIPTION OF THE DRAWINGS

A more complete understanding of the invention may be had by reference to the following Detailed Description when taken in conjunction with the accompanying Drawings wherein.

DETAILED DESCRIPTION

Figure 1:
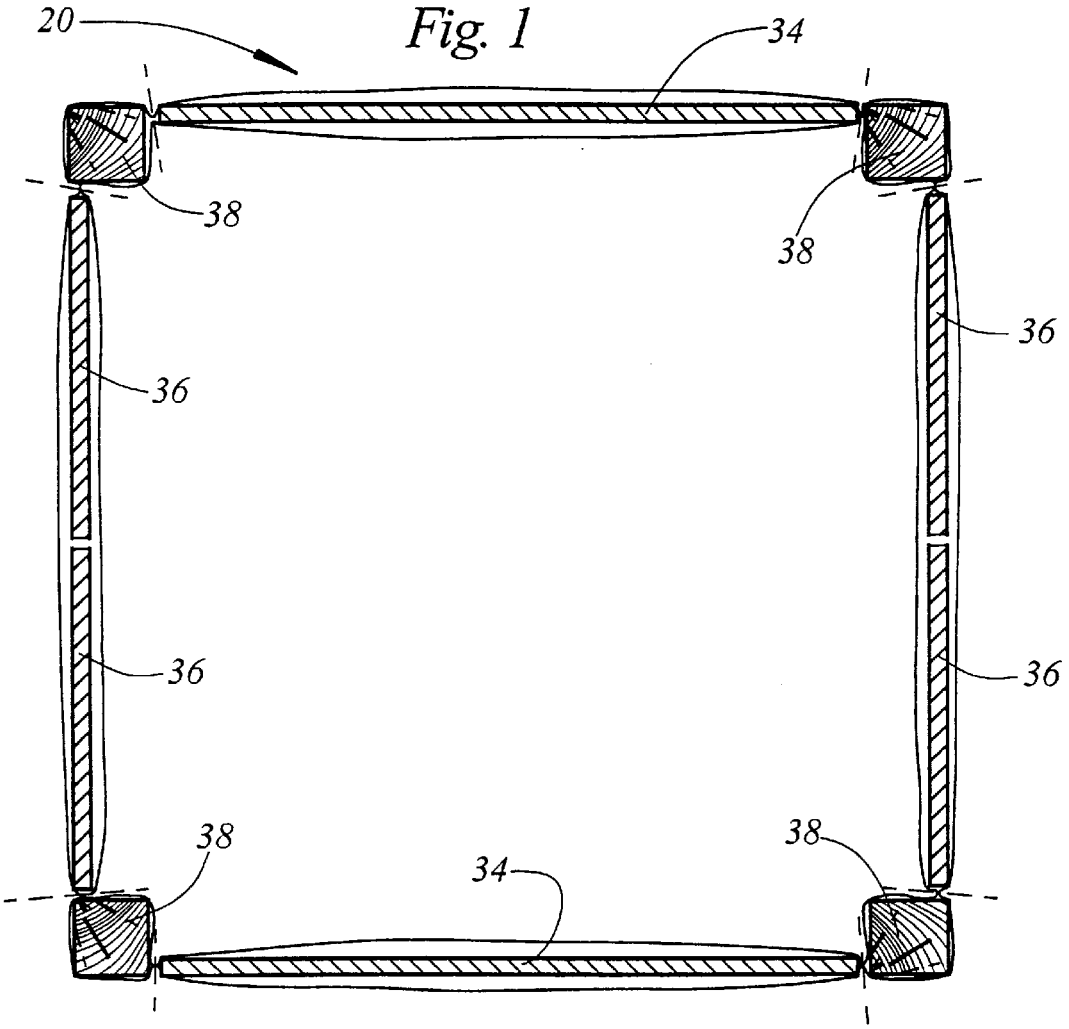
FIG. 1 is a diagrammatic illustration of a first embodiment of the invention.
Figure 2:
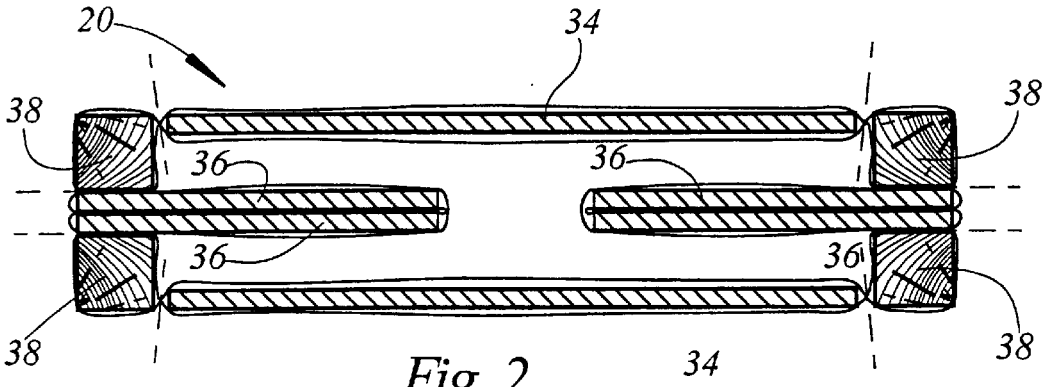
FIG. 2 is a diagrammatic illustration of the foldability of the first embodiment of the invention.
Figure 3:
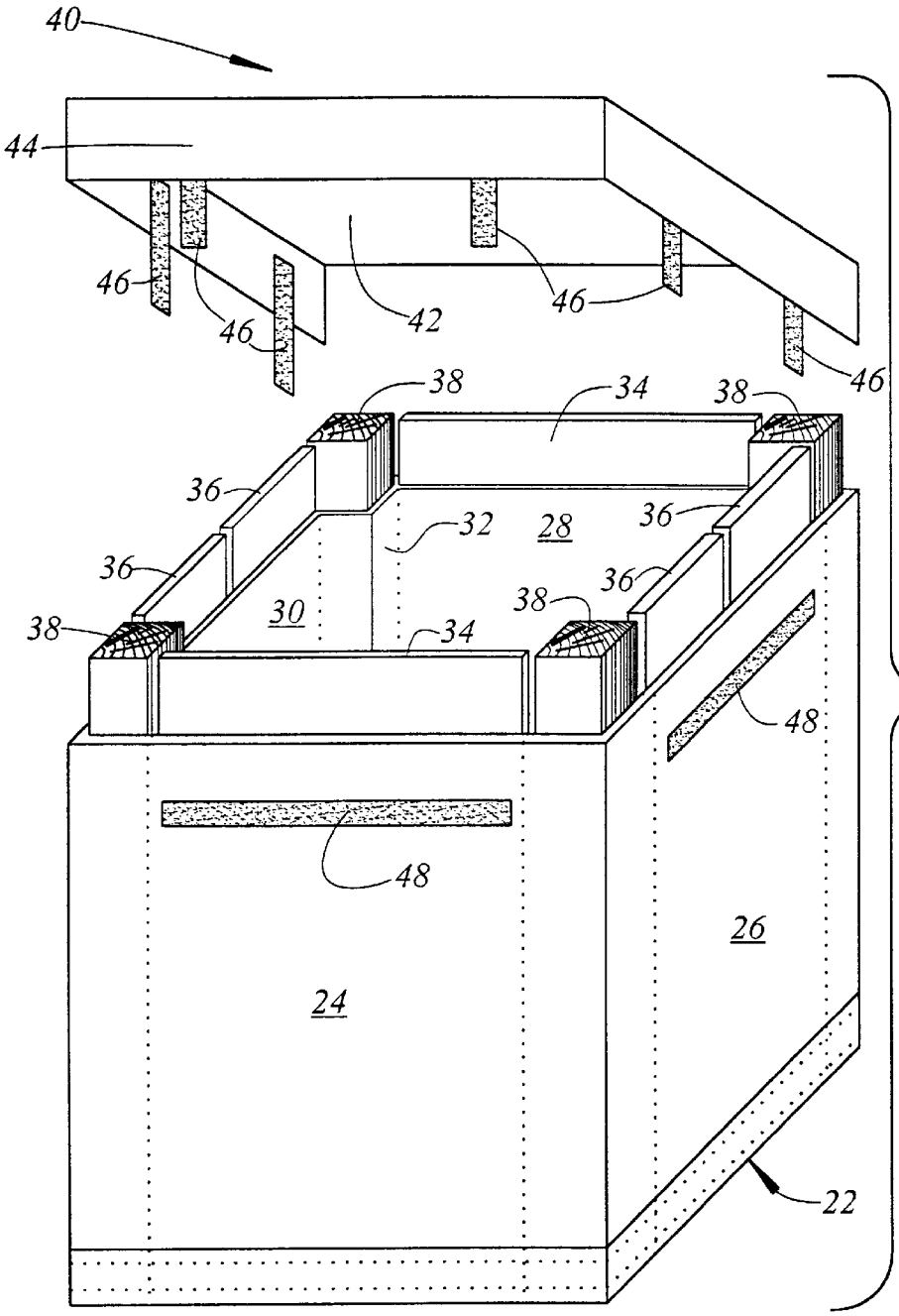
FIG. 3 is an exploded perspective view of the first embodiment of the invention.

Referring now to the Drawings, and particularly to FIGS. 1, 2 and 3 thereof, there is shown a bulk bag 20 comprising a first embodiment of the invention. The bulk bag 20 comprises a bottom wall 22 and four double layer side walls 24, 26, 28, and 30. The bottom wall 22 and the double layer side walls 24, 26, 28, and 30 are preferably fabricated from woven polypropylene fabric and are joined together by sewing in the conventional manner. Other materials and fabrication techniques can be used in constructing the bulk bag 20 depending upon the requirements of particular applications of the invention.

The double layer side walls 24 and 28 each receive a one piece stiffener panel 34. The double layer side walls 26 and 30 each receive a pair of stiffener panels 36. The use of the pairs of stiffener panels 36 in the side walls 26 and 30 facilitates the folding of the bulk bag 20 for storage and transportation prior to its ultimate utilization in the manner illustrated in FIG. 2.

The sleeves 32 each receive a corner stiffener rod 38. The stiffener rods 38 are preferably formed from wood and are preferably rectangular or square in configuration. The stiffener panels 34 and 36 which are received in the double layer side walls of the bulk bag 20 are preferably formed from oil impregnated five-ply plywood. Other conventional materials may be utilized in the practice of the invention, if desired.

Figure 4:
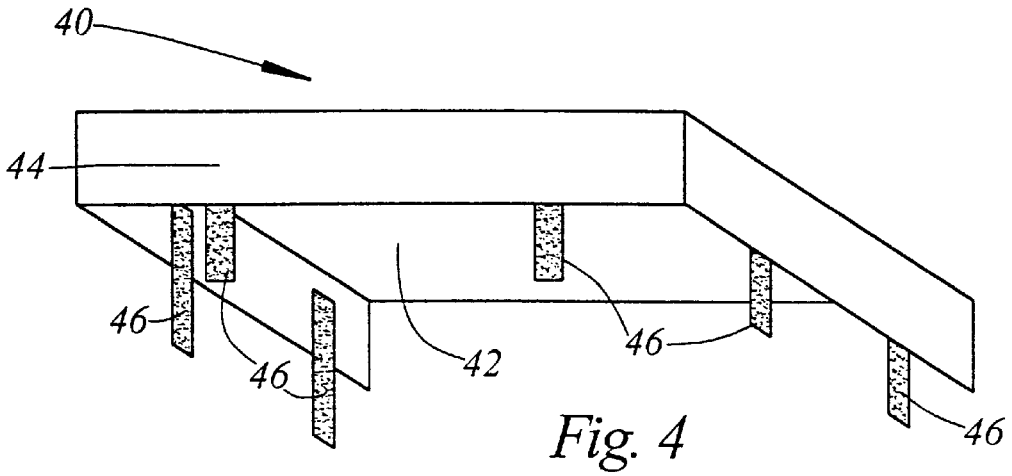
FIG. 4 is a perspective view of a container top useful in the practice of the invention.
Figure 5:
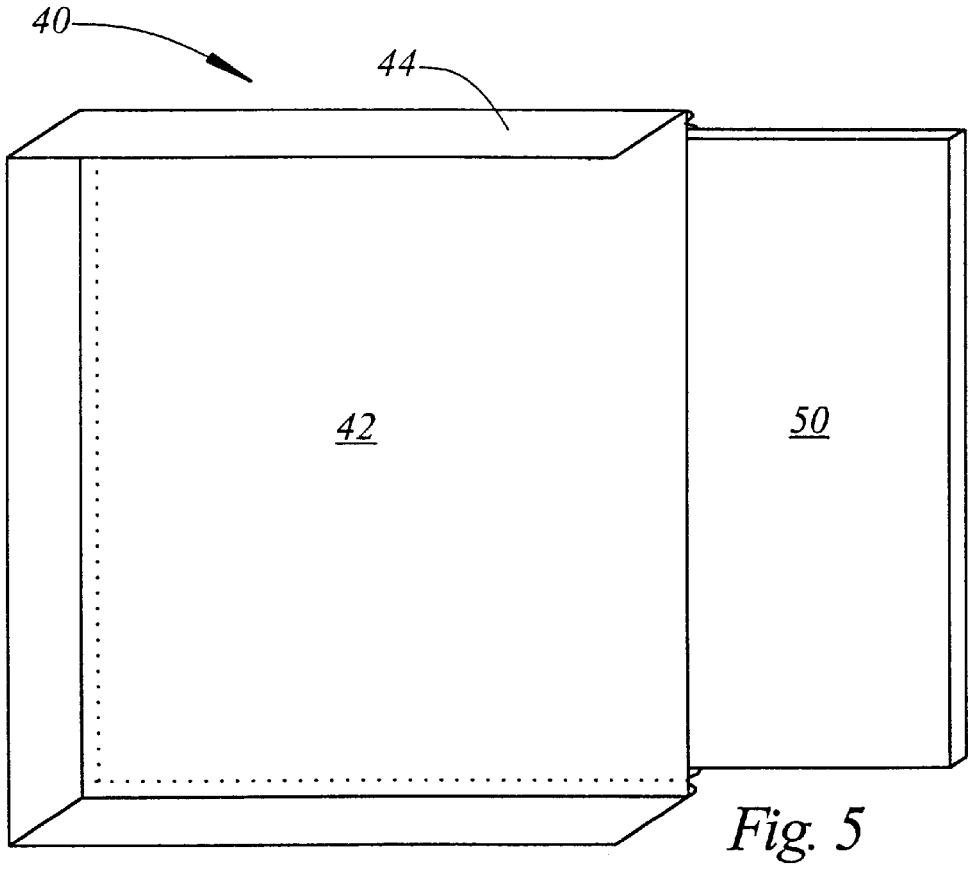
FIG. 5 is an illustration of the construction of the top of FIG. 4.

Referring to FIGS. 3, 4, and 5, the bulk bag 20 is provided with a top 40. The top 40 includes a double layer top wall 42 and a surrounding skirt 44. The top 40 is provided with a plurality of conventional fasteners 46 which cooperate with fastener receiving members 48 secured to the side walls of the container 20 to secure the top 40 in place. As is best shown in FIG. 5, the double layer top wall 42 receives a stiffener panel 50 which may be formed from oil impregnated five-ply plywood or other conventional materials in accordance with the requirements and particular applications of the invention.

Figure 6:
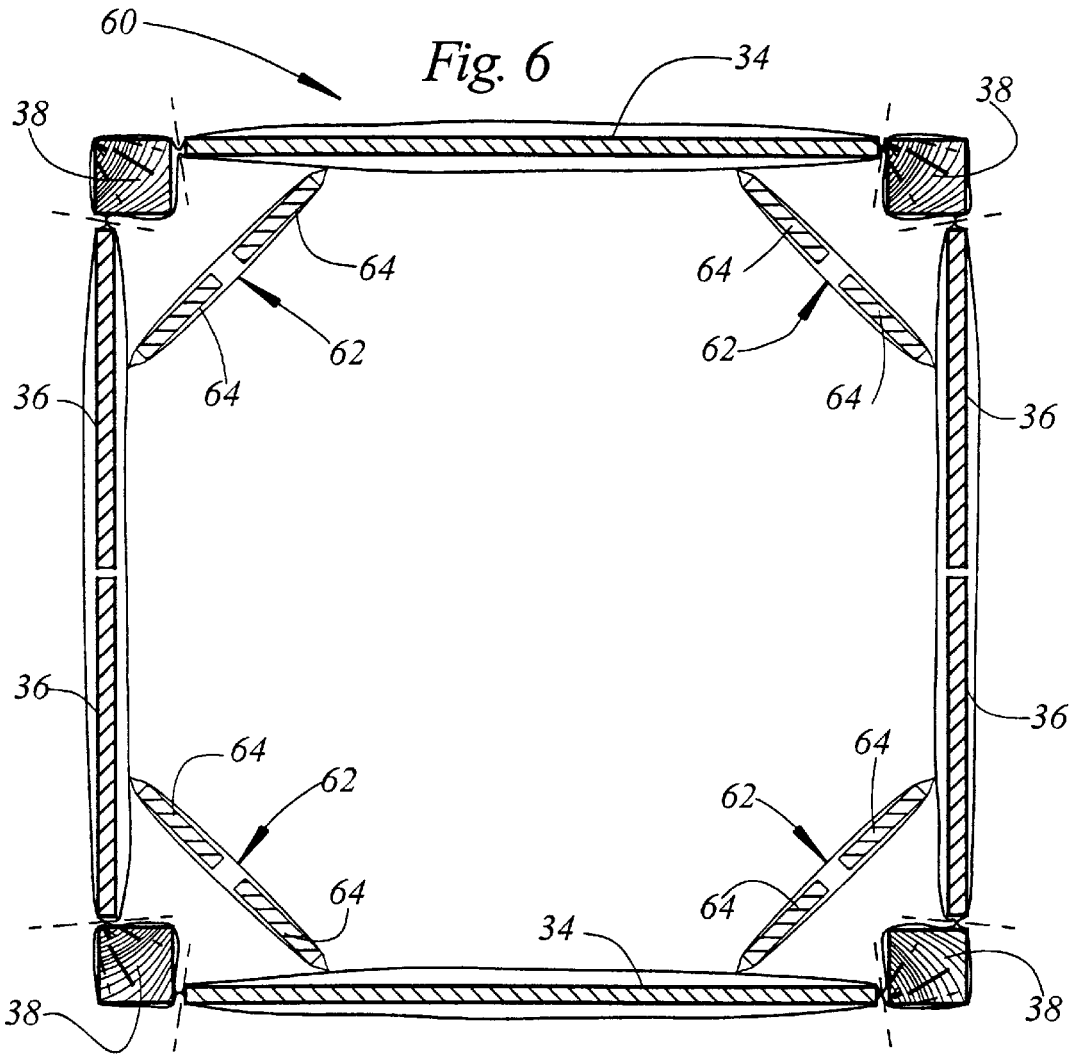
FIG. 6 is a diagrammatic illustration of a second embodiment of the invention.
Figure 7:
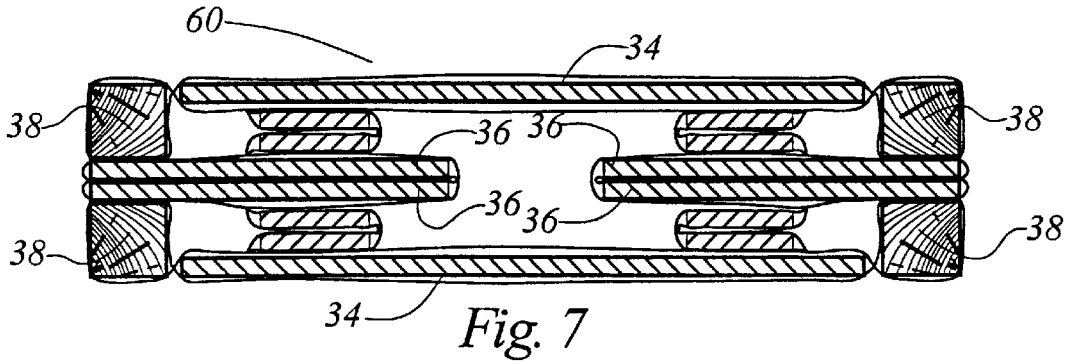
FIG. 7 is a diagrammatic illustration of the foldability of the second embodiment of the invention.
Figure 8:
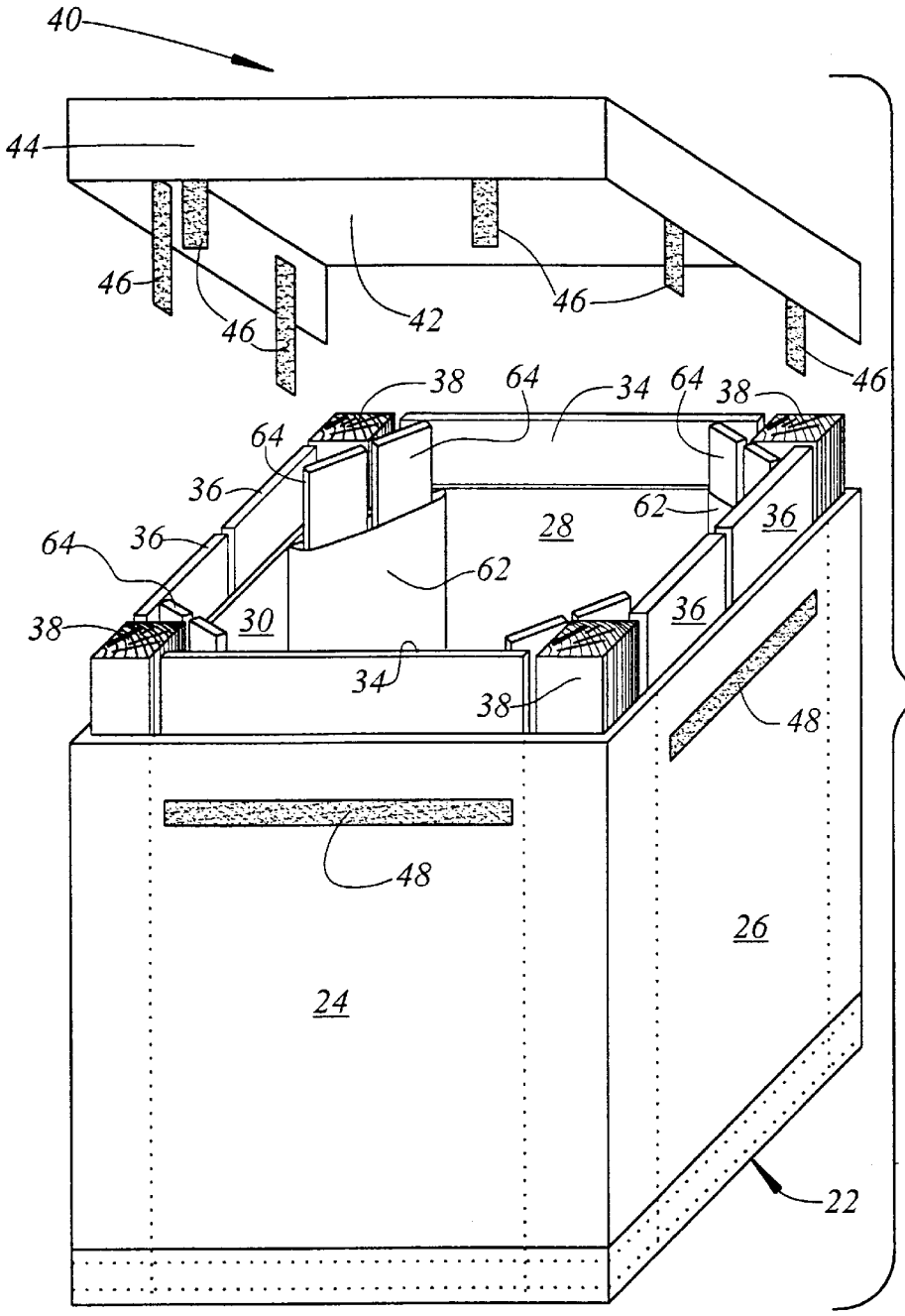
FIG. 8 is an exploded perspective view of the second embodiment of the invention.

A bulk bag 60 comprising a third embodiment of the invention is illustrated in FIGS. 6, 7, and 8. The bulk bag 60 is identical to the bulk bag 20 illustrated in FIGS. 1 through 5, inclusive, and described hereinabove in conjunction therewith except that the bulk bag 60 is provided with double layer baffles 62 extending diagonally across the interior corners of the bulk bag. The double layer baffles 62 are fabricated from woven polypropylene fabric and are connected to the double layer side walls of the bulk bag 60 by sewing in the conventional manner. Each double layer baffle 62 is provided with a pair of stiffener panels 64 which are preferably formed from oil impregnated five-ply plywood, it being understood that other conventional materials may be utilized in the fabrication of the bulk bag 60 and in the fabrication of the stiffener panels thereof in accordance with the requirements of particular applications of the invention.

The use of two stiffener panels 64 in each baffle 62 allows the baffles 62 to be folded inwardly. The use of two stiffener panels 36 in the side walls 26 and 30 of the bulk bag 60 allows the side walls 26 and 30 to be folded inwardly. In this manner the bulk bag 60 is adapted for folding into the configuration illustrated in FIG. 7, thereby facilitating the transportation and storage of the bulk bag prior to its ultimate utilization.

Figure 9:
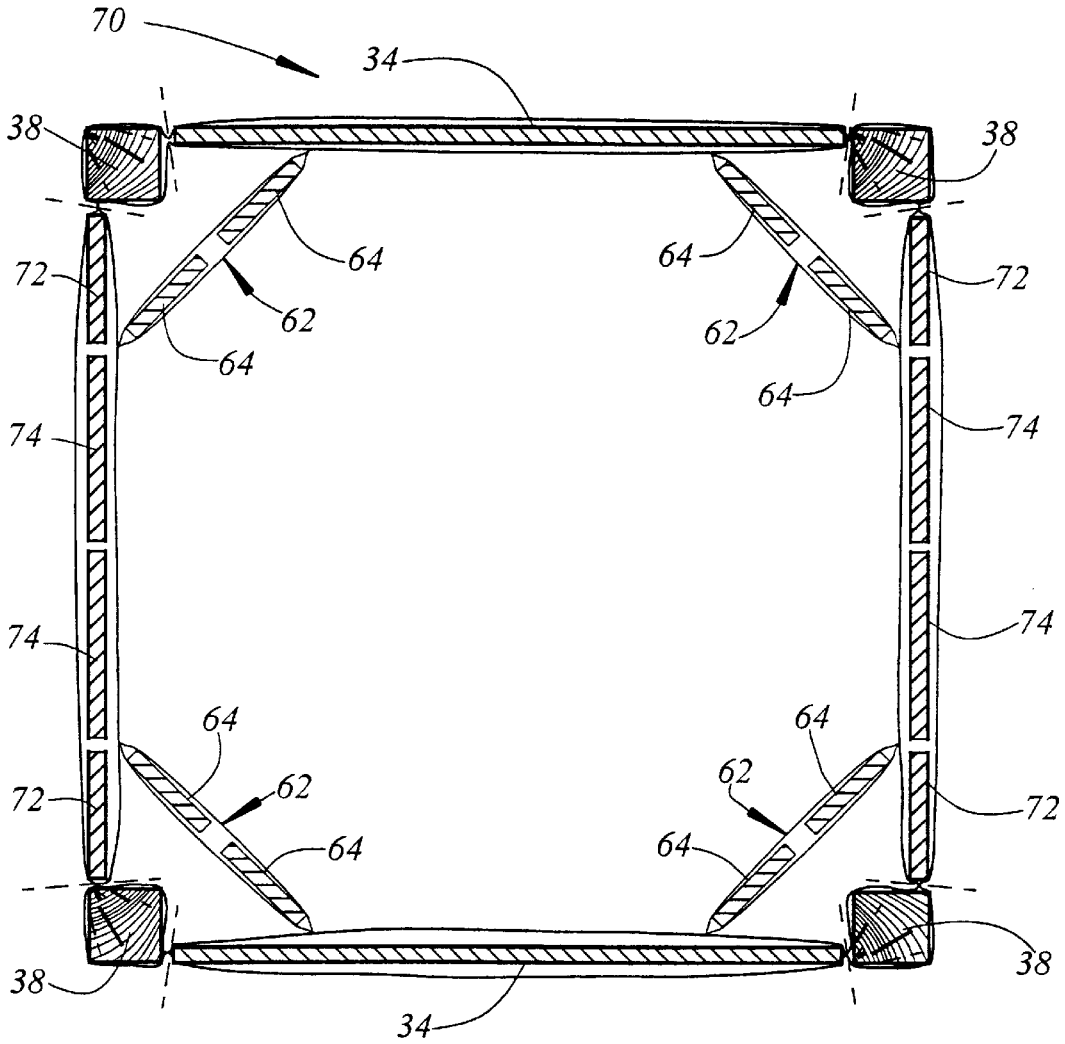
FIG. 9 is a diagrammatic illustration of a first variation of the second embodiment of the invention.

Referring to FIG. 9, there is shown a bulk bag 70 comprising a variation of the second embodiment of the invention. The bulk bag 70 differs from the bulk bag 60 in that the opposed double layer side walls 26 and 30 thereof are each provided with two stiffeners 72 located adjacent the ends of the side walls, and two stiffeners 74 located in the mid-portion of each side wall. The stiffeners 74 may be completely separate or hingedly interconnected depending on the requirements of the particular applications of the invention. The stiffeners 72 and 74 are preferably formed from oil impregnated by five-ply plywood, however, other conventional materials may be utilized in the fabrication of the stiffeners 72 and 74 depending on the requirements of particular applications of the invention.

Figure 10:
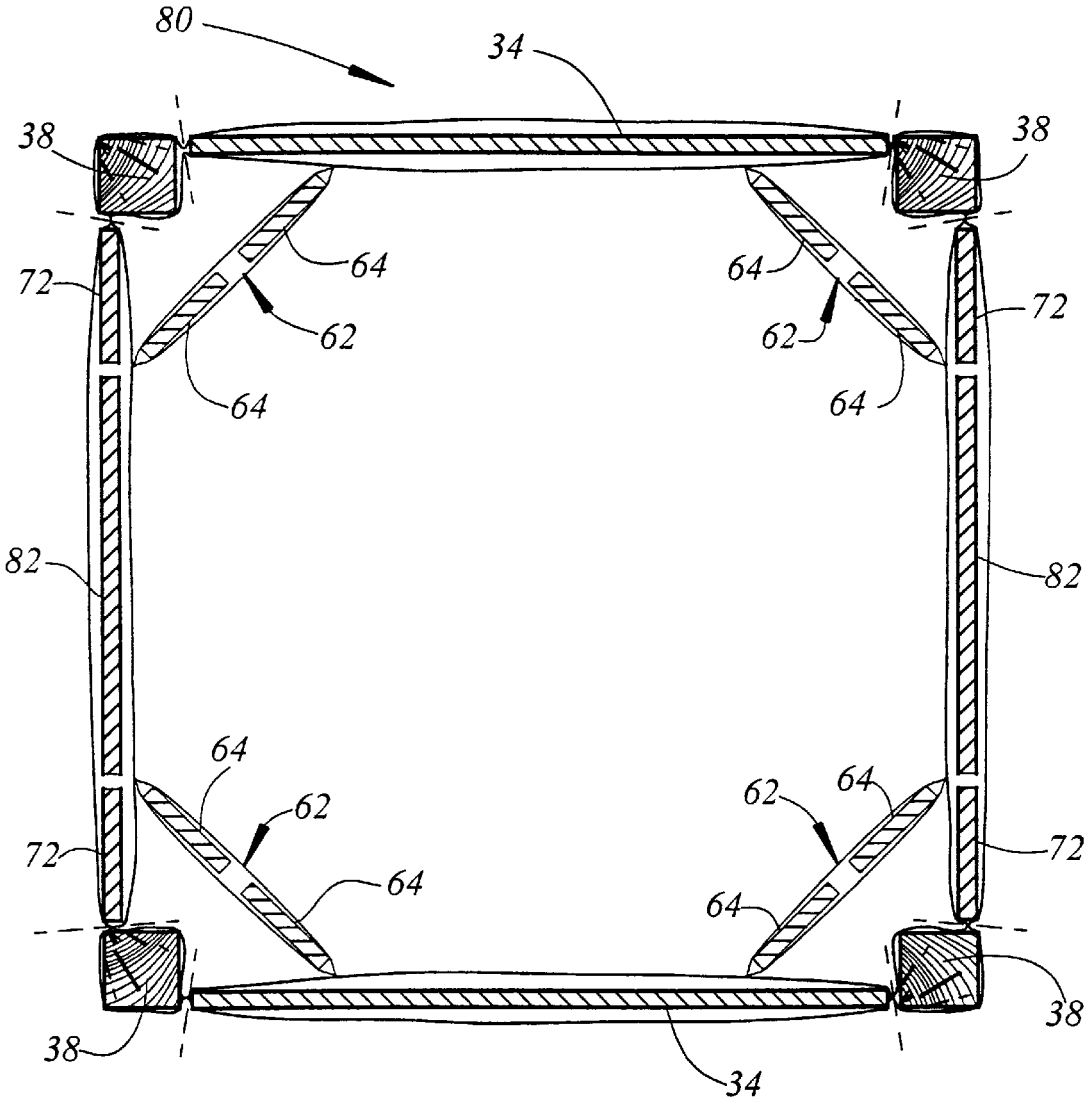
FIG. 10 is a diagrammatic illustration of a second variation of the second embodiment of the invention.

A bulk bag 80 comprising a second variation of the second embodiment of the invention is illustrated in FIG. 10. The bulk bag 80 differs from the bulk bag 70 illustrated in FIG. 9 and described hereinabove in conjunction therewith in that the bulk bag 80 employs a single stiffener 82 in the mid region of each of the double layer side walls 26 and 30. When the stiffeners 82 are utilized in lieu of the stiffeners 74, the side walls 26 and 30 of the bulk bag 80 are rendered non-foldable. This is advantageous in those applications of the invention in which the contents of the bulk bag are discharged by tipping the bulk bag so that the contents thereof flow outwardly from the open top.

It will be understood that the stiffeners 82 of the bulk bag 80 are interchangeable with the stiffeners 74 of the bulk bag 70. This is advantageous in that the same basic bulk bag construction can be utilized in the construction of two entirely different bulk bag types. In this manner inventory requirements are reduced and the adaptability of the bulk bag to particular applications of the invention is facilitated.

Figure 11:
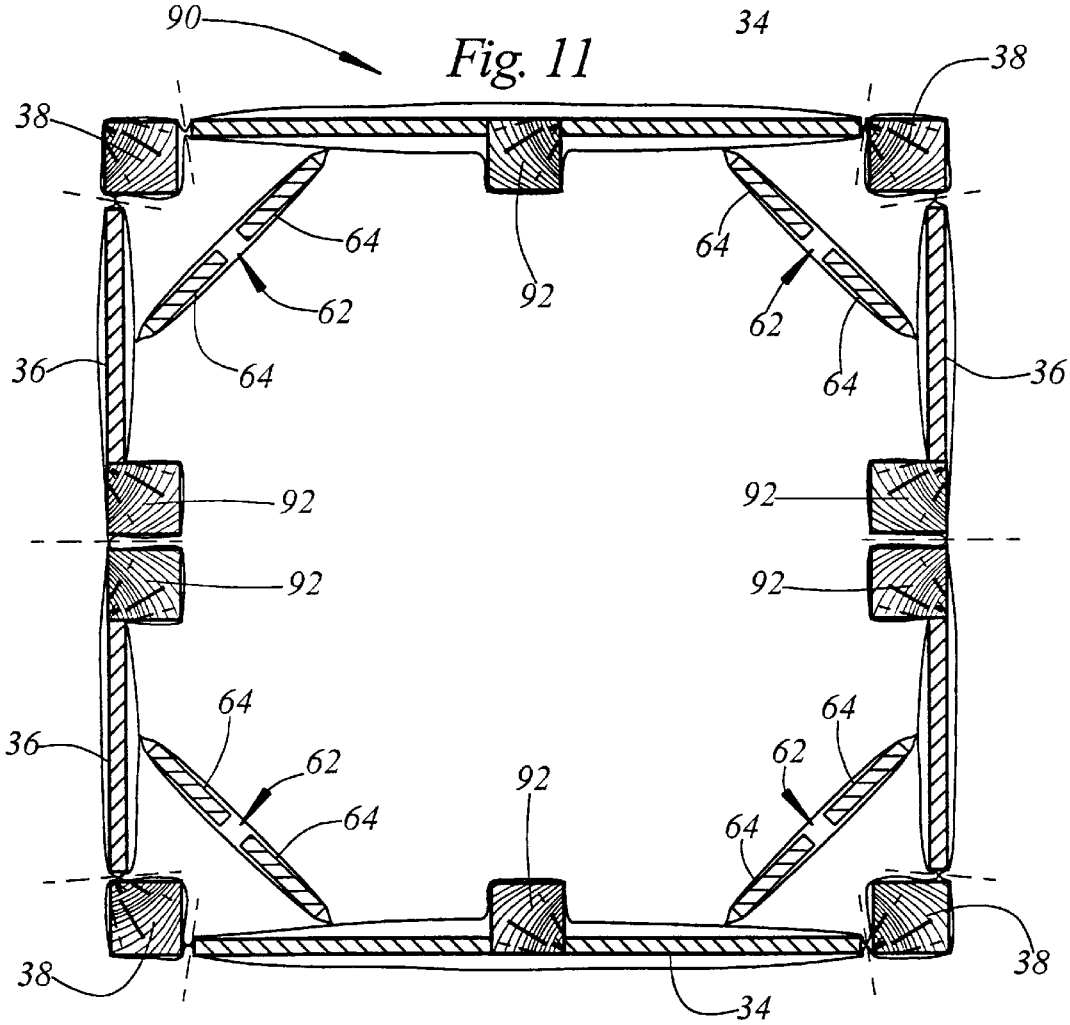
FIG. 11 is a diagrammatic illustration of a third embodiment of the invention.
Figure 12:
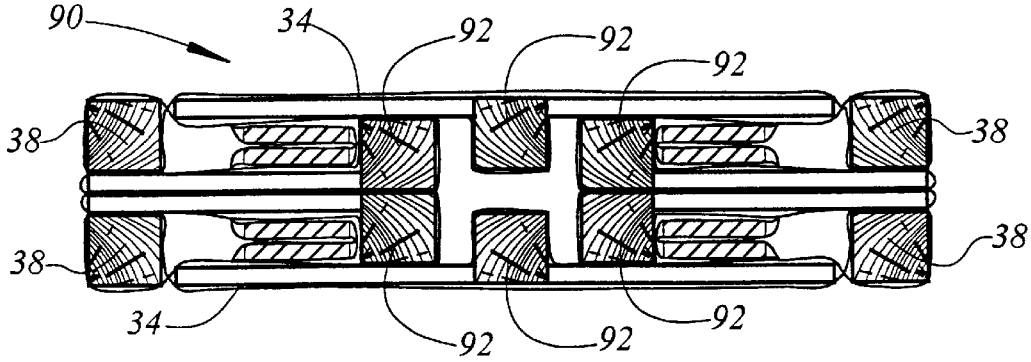
FIG. 12 is a diagrammatic illustration of the foldability of the third embodiment of the invention.

Referring to FIGS. 11 and 12, there is shown a bulk bag 90 comprising a third embodiment of the invention. The bulk bag 90 is virtually identical to the bulk bag 60 illustrated in FIGS. 6, 7, and 8 and described hereinabove in conjunction therewith. The bulk bag 90 differs from the bulk bag 60 in that it is provided with a plurality of additional sleeves similar to the sleeves 32 and in that it is provided with a plurality of additional stiffener rods 92 located in the mid-regions of the double layer side walls comprising the bulk bags. The additional stiffener rods 92 are preferably formed from wood, however, the additional stiffener rods 92 may be formed from other conventional materials depending upon the requirements of particular applications of the invention. The use of the additional stiffener rods 92 is advantageous in that it further increases the stackability of the bulk bag.

The use of two stiffener panels 64 in each of the baffles 62 allows the baffles 62 to be folded inwardly. The use of two stiffener panels 36 and the use of duplicate additional stiffener rods 92 in conjunction with each of the double layer side walls 26 and 30 allows the side walls 26 and 30 to be folded inwardly. In this manner the bulk bag 90 may be folded into the configuration illustrated in FIG. 12 to facilitate storage and transportation of the bulk bag prior to its ultimate utilization.

Figure 13:
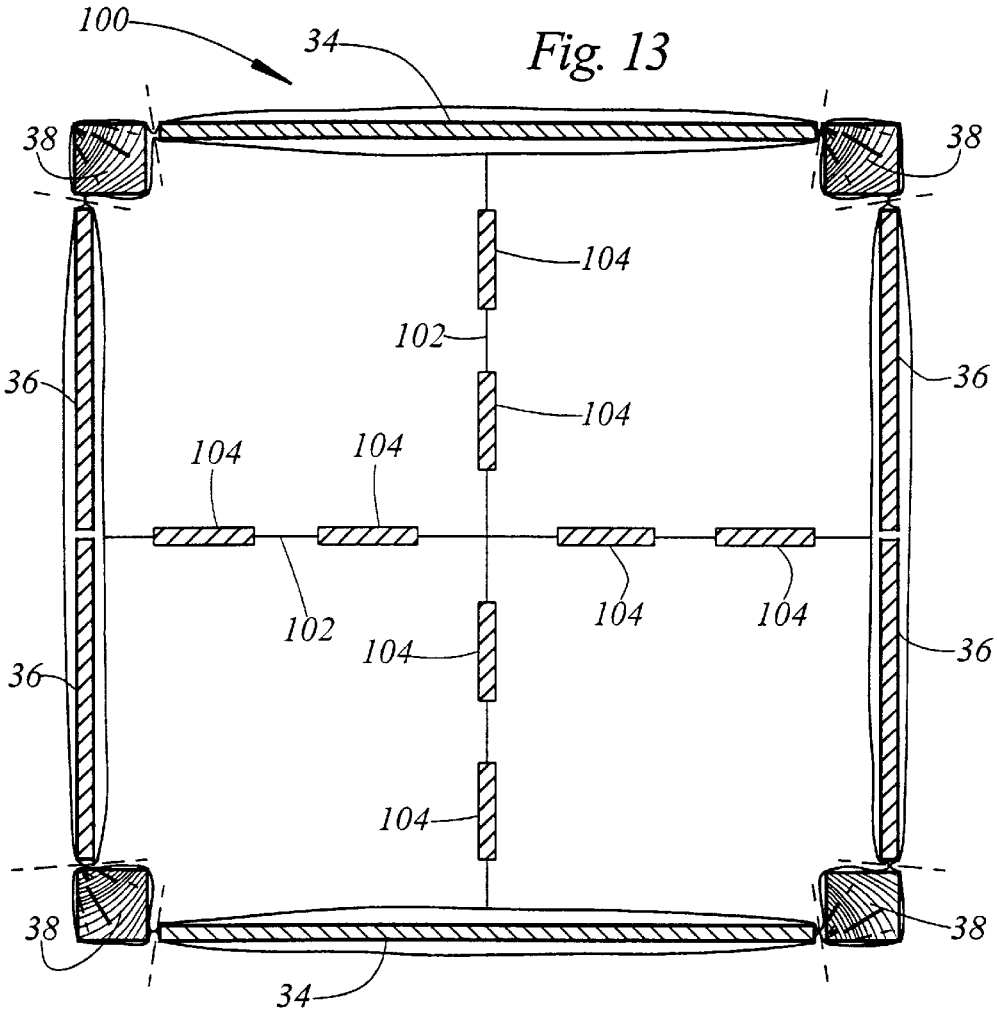
FIG. 13 is a diagrammatic illustration of a fourth embodiment of the invention.
Figure 14:
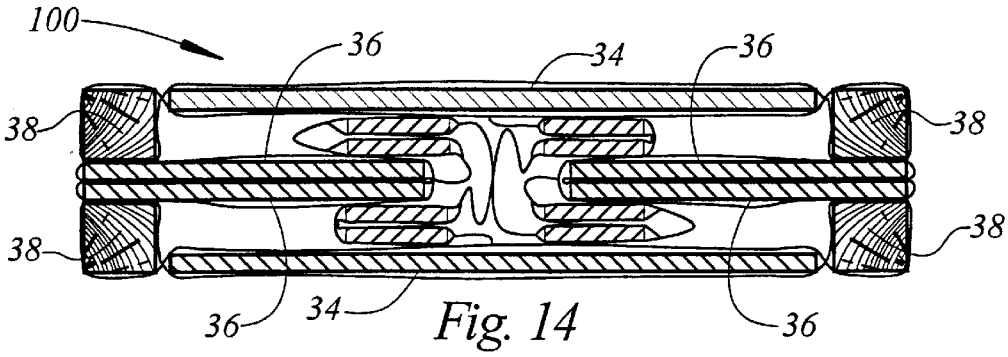
FIG. 14 is a diagrammatic illustration of the foldability of the fourth embodiment of the invention.
Figure 15:
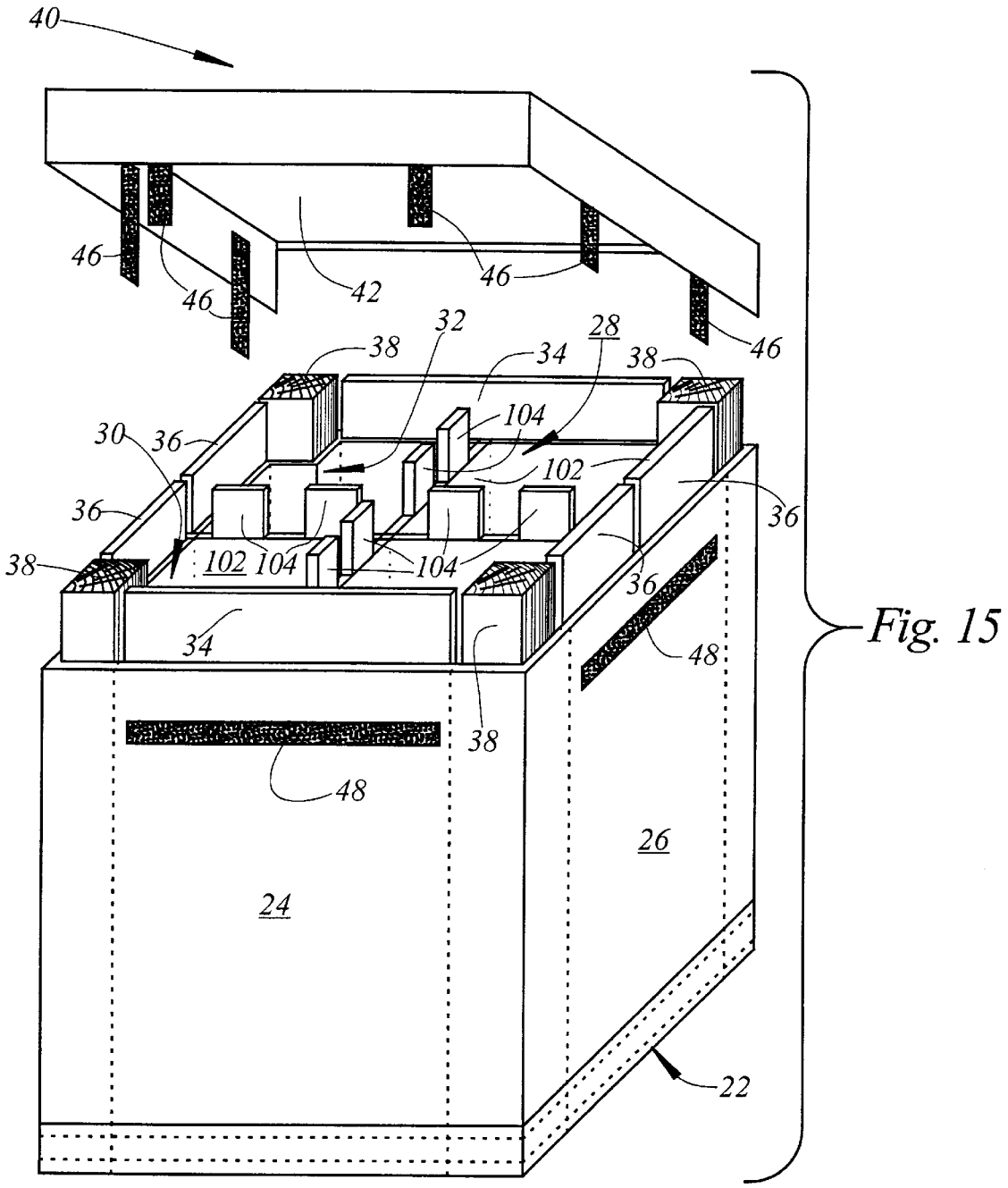
FIG. 15 is an exploded perspective view of the fourth embodiment of the invention.

Referring to FIGS. 13, 14, and 15, there is shown a bulk bag 100 comprising a fourth embodiment of the invention. The bulk bag 100 is virtually identical to the bulk bag 20 illustrated in FIGS. 1, 2, and 3 and described hereinabove in conjunction therewith. The bulk bag 100 differs from the bulk bag 20 in that it is provided with perpendicular double layer dividers 102 which extend across the interior of the bulk bag from the mid-points of the side walls thereof. The dividers 102 are preferably fabricated from woven polypropylene fabric and are secured to the side walls of the bulk bag 100 by sewing in the conventional manner. The dividers 102 are each provided with four stiffener panels 104 which are preferably formed from oil impregnated five-ply plywood. Other conventional materials may be utilized in the fabrication of the dividers 102 and the stiffener panels 104 depending upon the requirements of particular applications of the invention.

The dividers 102 separate the interior of the bulk bag 100 into four quadrants. This is advantageous in those applications of the invention in which different materials are received, stored, transported, and discharged from the same bulk bag. The use of the bulk bag 100 is also advantageous in those applications of the invention in which it is desirable to discharge a portion of the contents of the bulk bag without disturbing the remaining contents thereof.

The use of two stiffener panels 36 in the side walls 26 and 30 of the bulk bag 100 facilitates the folding of the side walls 26 and 30 inwardly. The use of multiple stiffener panels 104 in each double layer divider 102 of the bulk bag 100 facilitates the folding of the dividers 102. In this manner the bulk bag 100 can be folded into the configuration illustrated in FIG. 14 which facilitates storage and transportation of the bulk bag 100 prior to its ultimate utilization.

Figure 16:
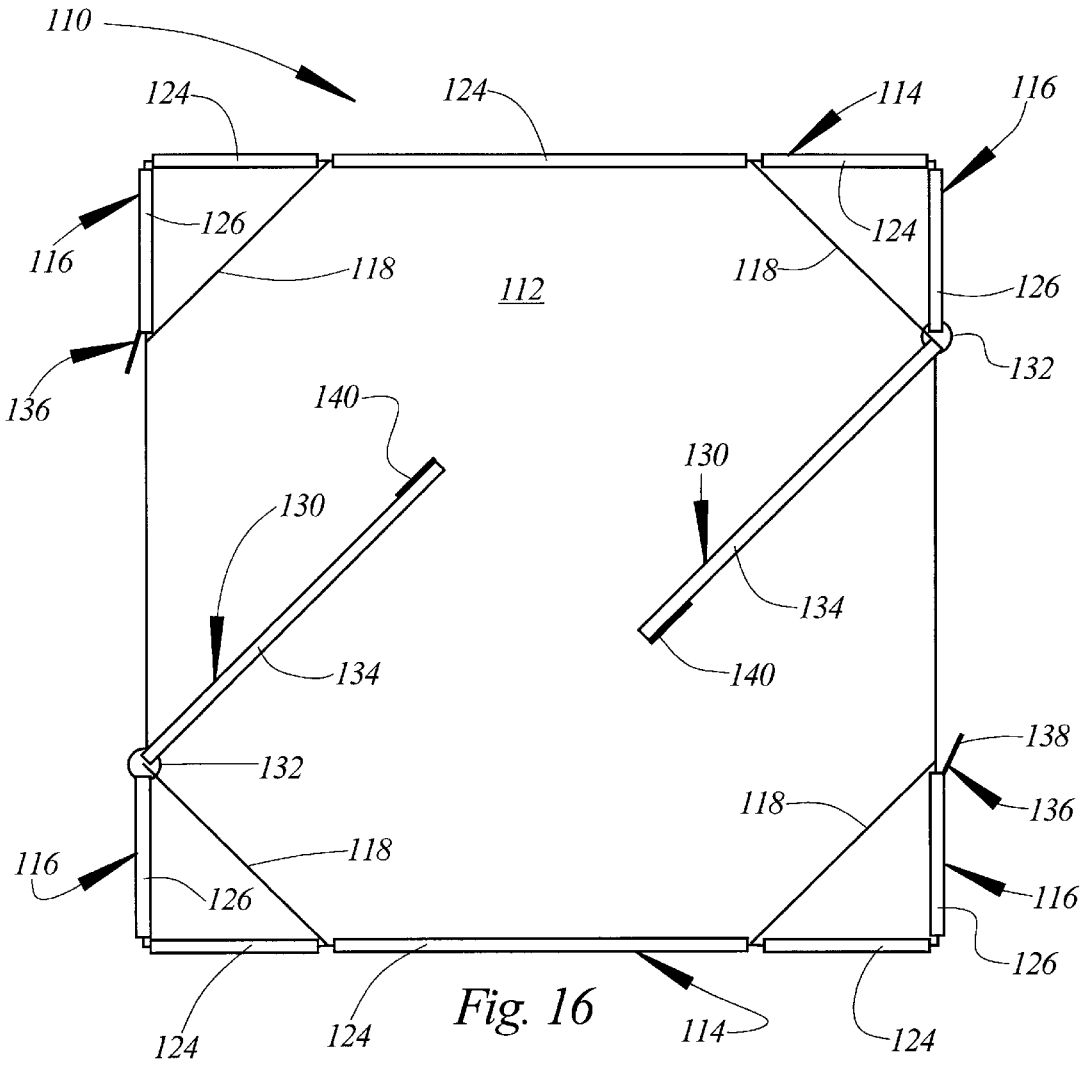
FIG. 16 is a diagrammatic illustration of a fifth embodiment of the invention.
Figure 17:
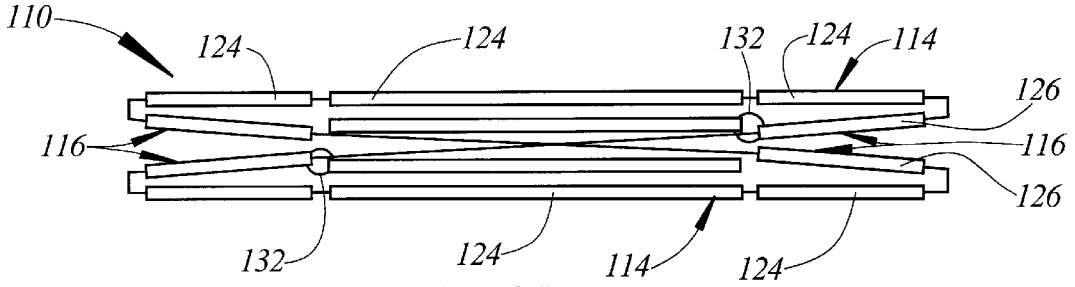
FIG. 17 is a diagrammatic illustration of the foldability of the fifth embodiment of the invention.

Referring now to FIGS. 16 and 17, there is shown a bulk bag 110 comprising the fifth embodiment of the invention. Many of the component parts of the bulk bag 110 are substantially identical in construction and function to component parts of the bulk bags illustrated in FIGS. 1–15, inclusive, and described hereinabove in conjunction therewith.

The bulk bag 110 includes a bottom wall 112. End walls 114 and partial side walls 116 are secured to the bottom wall 112 and extend upwardly therefrom. Baffles 118 are connected between the end walls 114 and the partial side walls 116 and extend across the corners of the bulk bag 110.

The end walls 114 of the bulk bag 110 are provided with stiffener panels 124. Similarly, the partial side walls 116 are provided with stiffener panels 126. The stiffener panels 124 and 126 may be formed from oil impregnated 5-ply plywood, other types of plywood, medium density fiberboard, and other, similar materials. Depending on the particular application of the invention, the stiffener panels 124 and 126 may also be formed from corrugated plastic panels. The baffles 118 may also be provided with stiffener panels constructed from the same types and kinds of materials as the stiffener panels 124 and 126, if desired.

The bulk bag 110 further comprises pivotally supported side walls 130. The pivotally supported side walls 130 are hingedly connected to the partial side walls 116 by fabric hinges 132, but are not connected to the bottom wall 112. The pivotally supported side walls 130 are provided with stiffener panels 134. Like the stiffener panels 124 and 126, the stiffener panels 134 may be formed from oil impregnated 5-plywood, other types of plywood, medium density fiberboard, and/or other materials depending upon the requirements of particular applications of the invention.

The pivotally supported side walls 130 may be secured in alignment with the partial side walls 116 by fasteners 136 which may include a portion 138 mounted on one of the partial side walls 116 and a cooperating portion 140 mounted on the corresponding pivotally supported side wall 130. The fasteners 136 may comprise hook and loop-type fasteners of the type sold under the trademark "VELCRO"®. The fasteners 136 may also comprise other conventional types and kinds of fasteners such as snaps, buckles, hook and eye-type fasteners, etc.

Referring particularly to FIG. 17, the use of the pivotally supported side walls 130 in the construction of the bulk bag 110 is advantageous in that the bulk bag 110 may be folded flat for shipment to the customer. Upon receipt of the bulk bag 110, the customer simply unfolds the bulk bag and engages the fasteners 136 with no further assembly being required. The use of the bulk bag 110 is further advantageous in that by means of the pivotally supported side walls 130, a 50% increase in packing density is achieved, which in turn yields a 50% reduction in transportation costs.

Although preferred embodiments of the invention have been illustrated in the accompanying Drawings and described in the foregoing Detailed Description, it will be understood that the invention is not limited to the embodiments disclosed but is capable of numerous rearrangements, modifications, and substitutions of parts and elements without departing from the spirit of the invention.

I claim:

1. A bulk bag comprising:

a bottom wall;

opposed end walls extending upwardly from the bottom wall and having opposed ends;

four side wall portions extending upwardly from the bottom wall and having opposed ends, one end of each side wall portion being secured to one end of one of the end walls;

two pivotally supported side walls each having opposed ends, one end of each pivotally supported side wall being hingedly secured to one of the side wall portions; and fasteners for releasably securing each pivotal side wall in alignment with two of the side wall portions.

2. The bulk bag according to claim 1 wherein each of the end walls comprises a double layer end wall and further including stiffener panels received between the double layers of the end walls.

3. The bulk bag according to claim 1 wherein each of the side wall portions comprises a double layer side wall portion, and further including stiffener panels received between the double layers of the side wall portions.

4. The bulk bag according to claim 1 wherein each of the pivotally supported side walls comprises a double layer pivotally supported side wall and further including stiffener panels received between the double layers of each of the pivotally supported side walls.

5. The bulk bag according to claim 1 wherein the end walls, the side wall portions, and the pivotally supported side walls each comprise double layer walls and further including stiffener panels received between the double layers of the end walls, the side wall portions, and the pivotally supported side walls.

6. The bulk bag according to claim 1 further including baffles extending across the corners of the bulk bag and each connected between the opposed end walls and the ends of one of the side wall portions.

7. The bulk bag according to claim 1 further including fabric hinges pivotally connecting the pivotally supported side walls to the side wall portions.

8. The bulk bag according to claim 1 wherein the fasteners for securing the pivotally supported side walls in alignment with the side wall portions comprise hook and loop type fasteners.

9. The bulk bag according to claim 1 further including fabric hinges for pivotally securing the pivotally supported side walls to the side wall portions and wherein the fasteners for securing the pivotally supported side walls in alignment with the side wall portions comprise hook and loop-type fasteners.

10. The bulk bag according to claim 1:

wherein the end walls, the side wall portions, and the pivotally supported side walls each comprise double layer walls;

further including stiffener panels received between the double layer walls comprising the end walls, the side wall portions, and the pivotally supported side walls;

further including fabric hinges for pivotally supporting the pivotally supported side walls on the side wall portions; and wherein the fasteners for securing the pivotally supported side walls in alignment with the side wall portions comprise hook and loop type fasteners.

* * * * *